United States Patent [19]

Young et al.

[11] Patent Number: 4,990,025

[45] Date of Patent: Feb. 5, 1991

[54] SOIL STABILIZING METHOD AND APPARATUS

[75] Inventors: Bryant C. Young; Arne L. Harris, both of Tucson, Ariz.

[73] Assignee: Soil Stabilization Inc., Tucson, Ariz.

[21] Appl. No.: 347,160

[22] Filed: May 3, 1989

[51] Int. Cl.[5] ..... E01C 19/18

[52] U.S. Cl. ..... 404/92; 108/111

[58] Field of Search ..... 404/27, 76, 90, 91, 404/92, 101, 108, 111; 106/405, DIG. 1

[56] References Cited

U.S. PATENT DOCUMENTS

| | | | |
|---|---|---|---|
| 1,997,959 | 4/1935 | Wood . | |
| 2,181,320 | 11/1939 | Flynn . | |
| 2,211,262 | 8/1940 | Flynn . | |
| 2,211,263 | 8/1940 | Flynn . | |
| 2,865,268 | 12/1958 | Gardner . | |
| 2,885,934 | 5/1959 | Gardner | 404/92 |
| 2,937,581 | 5/1960 | Havelin et al. . | |
| 3,224,347 | 12/1965 | Seaman . | |
| 3,573,620 | 8/1973 | Minnick | 404/76 |
| 3,598,027 | 8/1973 | Swisher, Jr. | 404/76 |
| 3,732,023 | 5/1973 | Rank et al. | 404/92 X |
| 4,300,853 | 11/1981 | Jones | 404/92 |

FOREIGN PATENT DOCUMENTS

| | | |
|---|---|---|
| 594621 | 3/1960 | Canada . |
| 1093397 | 11/1960 | Fed. Rep. of Germany . |
| 3023002 | 1/1982 | Fed. Rep. of Germany . |
| 293904 | 10/1971 | U.S.S.R. . |

OTHER PUBLICATIONS

"Surface Soil Stabilization Basics", by Walter D. Munn, *Highway & Heavy Construction,* Apr. 1989, pp. 36–39.

"Pulverization, Use of Lime/Fly Ash Cut Costs", by Walter D. Munn, *Highway & Heavy Construction,* Apr. 1989, pp. 42–44.

"Fly Ash Base Modification in Page", by Don Gehring, *Southwest Contractor,* Jan. 1989, pp. 15–19.

*Primary Examiner*—William P. Neuder

*Attorney, Agent, or Firm*—Cahill, Sutton & Thomas

[57] ABSTRACT

A tilling/stabilization apparatus for tilling and stabilizing a roadbed or other base layer of soil includes a large manifold for receiving metered amounts of pressurized fly ash or other powdery filler, binder, and/or sealer material and injecting it in the vicinity of a rotating tiller that is tilling the roadbed. A water manifold passing through a housing surrounding the tiller produces a dense water mist inside the housing, causing dust to settle and providing a cementitious mix of the fly ash with the tilled roadbase material. Reliable, economical filling of roads and stabilization of a road base is achieved.

12 Claims, 1 Drawing Sheet

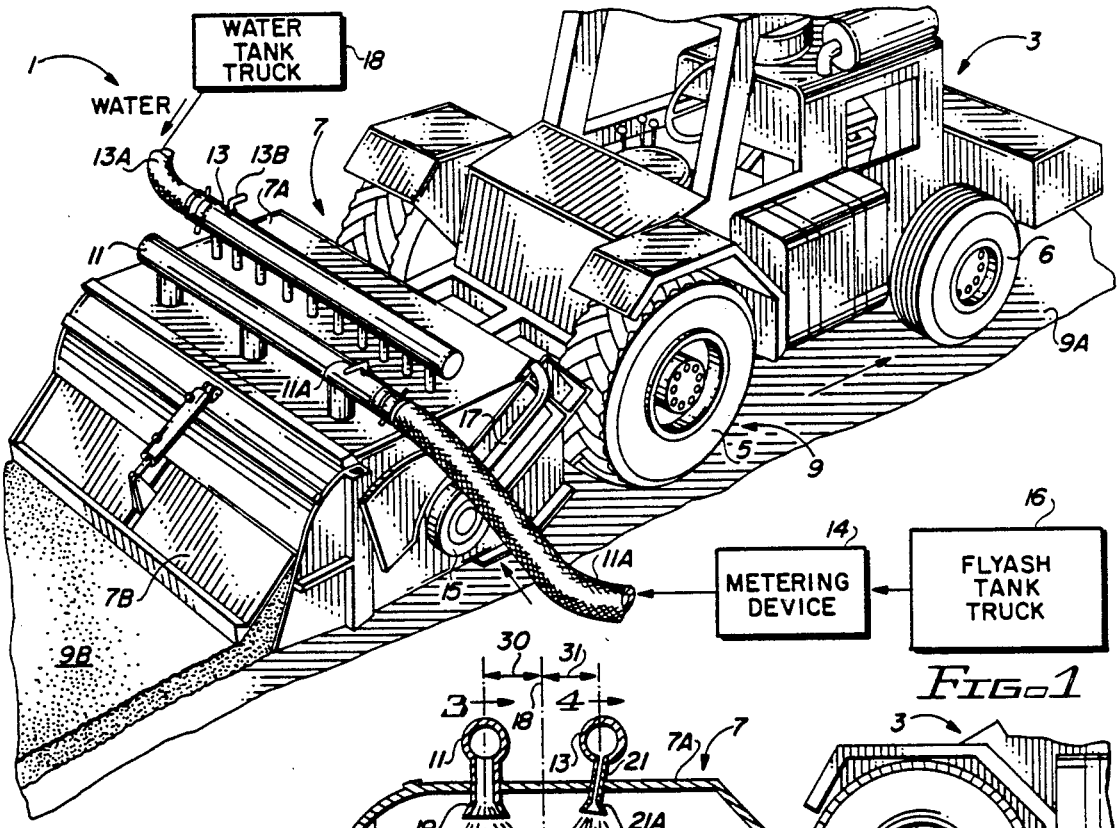
FIG. 1
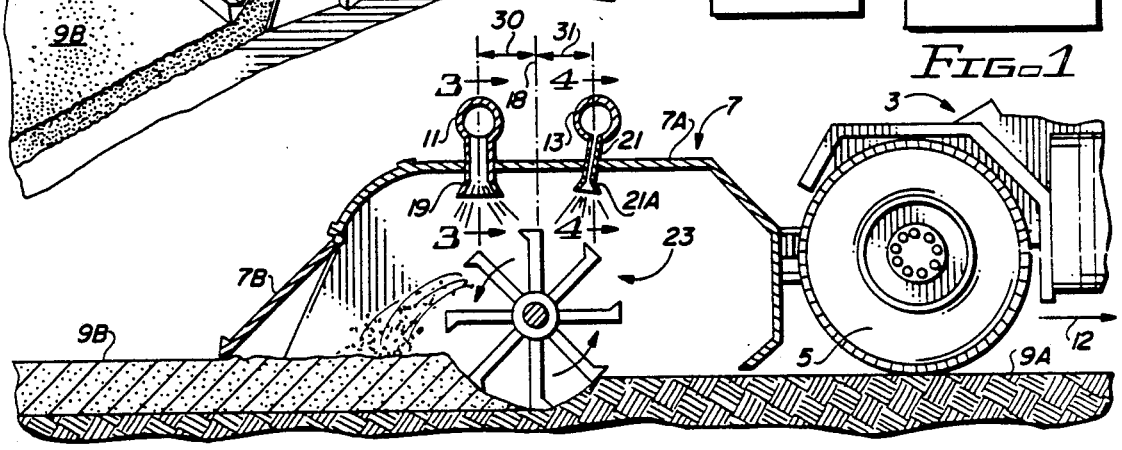
FIG. 2
FIG. 3
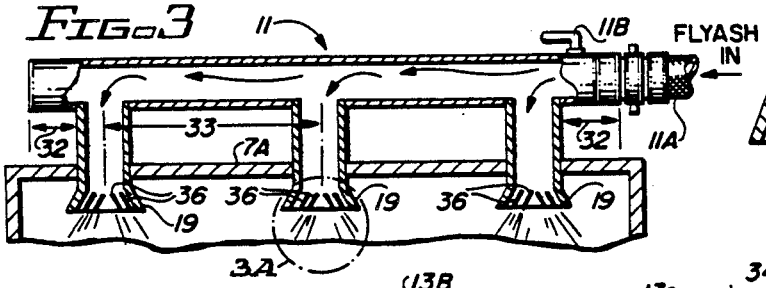
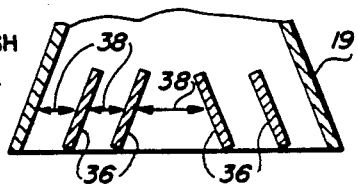
FIG. 3A
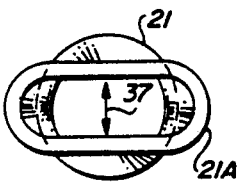
FIG. 4A
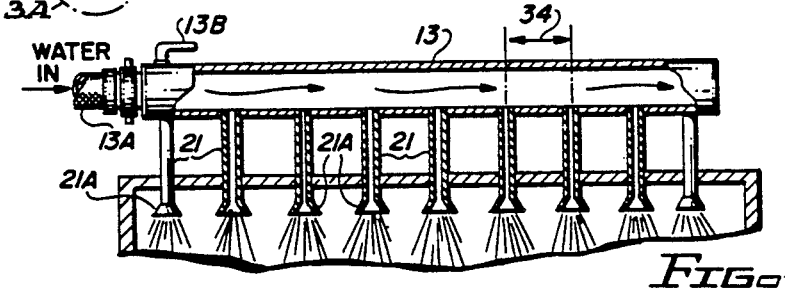
FIG. 4

SOIL STABILIZING METHOD AND APPARATUS

BACKGROUND OF THE INVENTION

Various techniques are known for stabilizing the soil or fill beneath pavement or other structural improvement to provide a stable, high integrity base therefor. Proving of a good, highly stabilized roadbed or other load base is essential if long life of the paved layer is to be achieved or if the load base is to possess the structural integrity needed to support the improvements. A variety of "aggregates" such as crushed rock have been utilized in forming roadbeds or other fill areas. When old pavement is cracked and base reconstruction is required, the usual procedure is to excavate and haul away the old base material, haul in new base material, and dump, spread, and compact the new base material. When practical, use of binding material for in-situ reconstruction of the existing base material can be much less expensive. In addition to more conventional fill and/or binder materials, a material called "fly ash" has been used to provide stabilized roadbeds by mixing a processed product such as fly ash with whatever soil already exists where the paved layer is to be deposited. The amount of fly ash or other filler/binder material to be mixed with the pre-existing soil depends heavily upon the characteristics of that soil. Engineering specifications typically indicate a required capability for carrying weights in pounds per square inch of the pavement. Types of roadbed material, such as clay, require stabilization to eliminate the plasticity of the material. Sandy types of roadbed foundation material require both binding and/or filler to fill air voids between particles of the road base material. Many types of binder material, such as cement, sand, lime, bentonite, and the like may be utilized. Stabilization of earth below buildings or other construction sites may require filler/stabilization material. It has been the practice to move substantial amounts of road base material, for example, a four foot layer, haul it away, and replace it with four feet of new filler material with binder and/or filler already mixed in. The replacement layer then is wet down and packed as necessary to achieve the needed density. Cementitious action between the binder and replacement material provides the needed stable road bed.

Fly ash is a material that is produced as a waste product from coal-fired plants of various kinds. Fly ash is so light and powdery that if a quantity of it is dumped on a horizontal surface, the fly ash "spreads out" to more or less uniformly cover a wide area. In other words, fly ash, like talcum powder, cannot be "piled up" effectively.

The known prior technique for mixing fly ash with pre-existing soil along a proposed roadway is to spread a thin layer (approximately three inches thick) along the roadway using a truck-mounted spreading device. A fine water spray is directed to limit the amount of fly ash "dust" that is generated. Then, a tilling device, such as a BOMAG Model MPH100 Recycler/Soil Stabilizer machine, is driven along the roadway on which the fly ash has been spread. The BOMAG machine includes a number of rotary tilling blades mounted under a trailing hood. Rotation of the tiller blades mixes the fly ash with the soil being tilled. If the roadbed soil is of a quality such that a large amount of fly ash is needed to achieve the degree of stabilization or void filling needed, it may be necessary to perform four or five operations each spreading three inch layers of fly ash and then re-tilling the soil before spreading the next layer of fly ash. The multiple passes are necessary because it is impossible to spread the fly ash in a layer more than three or four inches thick; however, ten to fifteen inches of fly ash may be needed to achieve proper stabilization wherein the mixed fly ash and soil react to cement the soil into the desired stable roadbed upon which a layer of pavement can be deposited so as to produce a durable, long life, paved roadway.

The highest known rate at which fly ash has been previously mixed with pre-existing soil using a tiller is 130 tons of fly ash per day. Four to five spreader truck loads of fly ash were spread on the surface and followed by a PULVAMIXER tilling device to achieve this rate.

One prior stabilizing machine is shown in Russian Patent No. 293,094, which discloses a rotary cutter that cuts through roadbed soil or the like. The rotary cutter is surrounded by a housing. Powderized binding material is fed through a gravity operated hopper into a stream of compressed air produced from a nozzle that blows the powderized binding material into the housing around the rotary cutter and into the vicinity of the rotor. A nozzle injects water sprayed to moisten the cementing mixture. The Russian patent does not disclose use of fly ash as the bonding agent or how the machine could be modified to effectively introduce fly ash into the tilled soil. Other references, including U.S. Pat. Nos. 2,937,581 and 3,753,620 disclose use of fly ash as a binder in soil to be stabilized to provide a roadbed, but do not disclose efficient, practical ways of introducing large amounts of the fly ash into the tilled soil.

It would be highly desirable to reduce the cost of mixing the needed amount of fly ash or other powdery binder or filler material into soil along a roadbed or other construction site and to provide a suitably stabilized roadbed or other soil base upon which a paved layer can be deposited so as to provide a durable, long life paved road, foundation, or the like. It also would be desirable to make it more practical to use fly ash as a filter/binder material in such applications, because disposing of fly ash often is a big problem.

SUMMARY OF THE INVENTION

Accordingly, it is an object of the invention to provide a method for mixing a large amount of fly ash or other powdery binder, filler, or sealer material with soil for a roadbed or foundation at a substantially lower cost and in substantially less time than has been previously achievable.

It is another object of the invention to provide an improved economical tilling machine capable of efficiently mixing a large amount of fly ash with tilled soil to provide a stabilized roadbed or construction site base.

It is another object of the invention to provide a method and apparatus which provides a thick, stabilized soil base containing a large amount of fly ash or other powdery filler or binder material and water in a single pass, without generating excessive dust.

It is another object of the invention to avoid the need to remove unstable roadbed or foundation material and replace it with substitute material containing a binder or filler.

It is another object of the invention to make it practical to use available fly ash as a filler or binder material for stabilizing soil bases.

Briefly described, and in accordance with one embodiment thereof, the invention provides a method and apparatus for simultaneously tilling a sufficiently deep layer of soil along a roadway or improvement site to provide a stabilized and/or sealed soil base, mixing in a sufficient amount of fly ash or other suitable binder, filler, or sealer material and also mixing in a sufficient amount of water in the form of a spray to provide a durable, reliable, stabilized and/or sealed soil base. A water manifold mounted on the outside of a hood covering a rotary tiller which tills a thick layer of soil. A plurality of tubes extend from the water manifold through the shroud to a region above the rotary tiller, injecting a dense, uniform spray of water inside the housing, prewetting the soil base being tilled. Water is supplied by a tanker truck moving slowly alongside a tractor on which the tiller is mounted. A second manifold is mounted behind the water manifold and includes a plurality of nozzles extending through the shroud. A flexible hose conducts powdery filler or binder material from another tanker truck moving alongside the filler/-stabilizer machine. The powdery filler/binder material is uniformly mixed with the prewetted soil being tilled. The dense spray of water both prewets the soil being tilled and prevents powder filler, binder, or sealer material from spreading outside the hood and causing dust-/particulate pollution.

BRIEF DESCRIPTION OF THE DRAWINGS

FIG. 1 is a perspective view of a roadbed tilling/-stabilizing apparatus in accordance with the present invention.

FIG. 2 is a partial section view across section line 2—2 of FIG. 1.

FIG. 3 is a section view taken across section line 3—3 of FIG. 1.

FIG. 3A is a section view taken along section line 3A—3A of FIG. 3A.

FIG. 4 is a section view along section line 4—4 of FIG. 1.

FIG. 4A is a bottom plan view of one of the nozzles shown in FIG. 4.

DETAILED DESCRIPTION OF THE PREFERRED EMBODIMENT

Referring to the drawings, roadbed stabilization apparatus 1 includes a tractor 3 supporting a tiller/stabilizer machine 7. Tractor 3 is supported by its rear wheels 5 and front wheels 6 along a roadbed 9 which is to be prepared for deposition of pavement. The tilling/stabilizing machine 7 includes a rotary tiller 23 including a plurality of tines or blades as shown in FIG. 2 driven by an hydraulic motor 15 (FIG. 1). Hydraulic motor 15 is connected by a tube 17 to a hydraulic pump (not shown) in tractor 3. The tractor 3 and the portion of the tiller/-stabilizer machine 7 described thus far can be a BOMAG MPH 100 Recycler/Soil Stabilizer available from BOMAG USA, Springfield, Ohio. The device is capable of tilling a roadway layer up to about 12 inches in depth. The BOMAG MPH 100 includes a manifold which is commonly used for dispensing liquid asphalt or oil into the substrate material being pulverized by the rotary tillers 23.

In accordance with the present invention, a machine such as the BOMAG MPH 100 is modified by provision of a fly ash manifold 11 and a water injection manifold 13. Fly ash injection manifold 11 is connected by a flexible hose 11A to a metering device 14 that pumps a controlled amount of fly ash into manifold 11 from a fly ash tank truck 16. Water is pumped via flexible hose 13A into water manifold 13 from a water tank truck 18. The tank truck 18 and the fly ash tank truck 16 move alongside of tilling/stabilizing apparatus 1 as it moves in the direction of arrow 12 along roadbed 9. In FIG. 1, numeral 9A designates the untilled portion of roadbed 9, and 9B designates the portion behind tiller/stabilizer machine 1 which has been tilled and simultaneously mixed with water and fly ash in accordance with the present invention to provide a roadbed (or other foundation) that becomes stabilized due to the mixing and cementitious reaction of the roadbed base material and the fly ash and water injected from the manifolds 11 and 13, respectively.

As best seen in FIGS. 2–4, fly ash manifold 14 has three large injection tubes 19 that extend through the upper surface of the housing of tiller/stabilizer machine 7. The water manifold 13 has 17 tubes 21 extending through the top surface of the tiller assembly 7. The inside diameter of fly ash manifold 11 and the base 11A is three and three fourths inches in the described prototype of the invention. The inside diameter of the outlet tubes 19 also is three and three fourths inches. The spacings indicated by dimension arrows 32 in FIG. 3 are 11 inches, the width of the surface 7A of the tiller/-stabilizer apparatus 1 being equal to 7 feet. The center-to-center spacing between the three outlet tubes 19 indicated by dimension arrow 33 in FIG. 3 is 2 feet, 6 inches. Each of the three outlet tubes 19 includes four elongated, rectangular deflection vanes 36, as best shown in FIG. 3A. Each of the deflection vanes 36 has a longitudinal axis that is perpendicular to the rotary axis of tiller 23 and extends substantially across the outlet opening of tube 19. The left two deflection vanes 36 are oriented to the left, as indicated in FIG. 3A, and the right pair of deflection vanes 36 are tilted to the right, as indicated in FIG. 3A. The deflection vanes 36 can be adjustable to allow better control of the disburs-ion of fly ash or other filler, binder, and/or sealer material within the housing of tilling/stabilizing machine 7. The orientation of the vanes is quite important to proper mixing of the fly ash into the prewetted tilled soil. A tilt of the vanes is approximately 30° from vertical, and the dimensions are $\frac{1}{4}$ of an inch in thickness by one inch in height, with length selected to extend across the outlet opening of tube 19. The spacings designated by dimension arrows 38 in FIG. 3A are selected to be approximately equal. The length of the tubes 19 is 10 inches, 8 inches of which is above the surface 7A.

The inside diameter of water manifold 13 is two inches. The inside diameter of the tubes 21 is three-fourths of an inch. The lower ends 21A are crimped as indicated in FIG. 4A, to a generally elliptical configuration, wherein the dimension indicated by numeral 37 is approximately one half of an inch, and the major elliptical axis is parallel to the rotary axis of tiller 23. The center-to-center spacings between the tubes 21 is 4.35 inches, and the outer tubes 21 are approximately 5 inches from the opposed edges of the housing of tilling/stabilizing machine 7. As best seen in FIG. 2, tubes 21 are tilted forward five to ten degrees. Tubes 21 are 10 inches long, 8 inches of which is above the supporting surface 7A of the housing.

The above described configuration of the water manifold 13 is located forward relative to the fly ash manifold 11, approximately six inches to the right of axis 18, as indicated by dimension arrows 31 in FIG. 2. This placement of tubes 21 and providing the large number of nozzles 21 under hood 7A was found to be important to the workability of the invention. More specifically, this was found to be necessary to properly "prewet" the soil being tilled by a uniform spray of water above the tiller 23. In order to achieve the necessary dust control, it was necessary that the spray be uniformly spread throughout the inside of hood 7A. It was also necessary to avoid "clotting" of fly ash material with water before mixing due with the roadbed material occurs. The optimum placement for the fly ash manifold 11 was found to be approximately 8 inches behind the rotational axis 18 of tiller 23, as indicated by dimension arrows 30 in FIG. 2.

EXAMPLE

The tiller/stabilizer machine of FIGS. 1–4 was used to tear up and remove the several inches of old asphaltic concrete pavement. Then using the machine of FIG. 1, an 8 inch layer of the roadbed was tilled. Fly ash was fed into fly ash manifold 11 at the rate of approximately 21 pounds per sq. ft. This amount of fly ash is equivalent to an 8 inch layer of fly ash being mixed into the 8 inch tilled layer 9B (FIG. 2). Water was fed into the manifold 13 at a rate of approximately 2 gallons per sq. ft. A BROS. TT sheepsfoot roller was utilized to compact the in situ base material as needed to achieve the desired density of the roadbase material. In this case, the initial roadbed density was relatively low, at 117.6 pounds per cu. ft. Approximately 20 pounds of fly ash per square foot of roadbed surface area were required to provide suitable void filling and stabilization of roadbed 9 so that it would withstand a load of 650 pounds per square foot. Utilizing a grading machine, the surface was graded and shaped as required to bring the roadbed surface to a specified level. A rubber tire roller was utilized to effectuate final compaction to 100% Proctor. The roadbed surface was kept wet. The nozzles at the ends of tubes 21 produced a dense, uniform spray or mist throughout the hood or housing of tiller/stabilizer unit 7, resulting both in essential dust control and cementitious binding action of the fly ash mixed with the pre-existing roadbase material. Proper placement of the fly ash nozzles and the water spray mist and providing sufficient water pressure in the manifold 11 to effectuate the spray were found to be essential to achieve both good dust control and adequate supply of water to be mixed with the fly ash and the base material being tilled.

The above example resulted in mixing 364 tons of fly ash into the roadbed in a single day, more than twice the previous amount of 130 tons per day previously achievable, thereby resulting in a substantial savings in the construction of the roadbed. The need to use an expensive spreader was avoided, and two fewer workers were required than if prior fly ash stabilization procedures had been used.

While the invention has been described with reference to a particular embodiment thereof, those skilled in the art will be able to make various modifications to the described apparatus and method without departing of the true spirit and scope of the invention.

What is claimed is:

1. A method of introducing powdery filler material into base material of a load base, comprising the steps of:

(a) operating a tiller machine to till a layer of the base material by means of a tiller element under a hood;

(b) simultaneously with step (a), spraying a dense spray of water through a plurality of nozzles extending from a first manifold through the hood over a rotary tiler element and located ahead of a rotation axis of the tiller element to prewet base material being tilled;

(c) simultaneously with steps (a) and (b), spraying a powdery filler material from a plurality of nozzles extending from a second manifold through the hood behind the first manifold and located behind the rotation axis to effectuate uniform mixing of the powdery filler material with the tilled, prewetted base material and to prevent spreading of dust including the powdery filler material outside of the shroud.

2. The method of claim 1 including first removing a layer of old pavement from the load base.

3. The method of claim 1 including selecting both the pressure of water in the first manifold and the number and size of the nozzles connected to the first manifold to produce a desired level of cementitious binding of the base material.

4. The method of claim 3 wherein step (a) includes tilling the layer approximately 8 to 12 inches thick, step (b) includes spraying fly ash supplied through a flexible hose to the second manifold from a first tank truck moving with the tiller machine, and supplying water to the first manifold from a second tank truck moving with the tiller machine.

5. In a moving tiller/stabilization machine, the improvement comprising:

(a) a first manifold having a plurality of nozzles extending from the first manifold through a top of a housing surrounding a rotary tiller element, the nozzles of the first manifold being located in front of a rotation axis of the rotary tiller element;

(b) means for conducting water from a first source at a preselected pressure to uniformly spray a selected amount of water from the nozzles into the base material being tilled by the rotary tiller;

(c) a second manifold having a plurality of nozzles extending from the second manifold through the top of the housing, the nozzles of the second manifold being located behind the rotation axis;

(d) means for conducting powdery material from a second source and spraying it through nozzles extending from the second manifold into the housing behind the spray of water.

6. The improvement of claim 5 wherein the inside diameter of the water manifold is approximately two inches, there are approximately 17 of the nozzles extending from the first manifold, the inside diameter of each of the nozzles extending from the first manifold is approximately three-fourths of an inch, and wherein the inside diameter of the second manifold is four inches, there are three of the nozzles extending from the second manifold, the inside diameter of each of the three nozzles being approximately three and three-fourths inches.

7. The improvement of claim 6 including means for pumping approximately 1200 pounds per minute of the powdery material into the housing and means for supplying approximately 950 pounds of water per minute into the housing.

8. The improvement of claim 7 wherein the powdery material includes filler material.

9. The improvement of claim 7 wherein the powdery material includes binder material.

10. The improvement of claim 7 wherein the powdery material includes sealer material.

11. The improvement of claim 7 wherein the nozzles of the first manifold are located approximately six inches in front of the rotation axis and the nozzles of the second manifold are located approximately eight inches behind the rotation axis.

12. A method of introducing powdery binder material into base material of a load base, comprising the steps of:

(a) operating a tiller machine to till a layer of the base material by means of a tiller element under a hood;

(b) simultaneously with step (a), spraying a dense spray of water through a plurality of nozzles extending from a first manifold through the hood over a rotary tiller element and located ahead of a rotation axis of the tiller element to prewet base material being tilled;

(c) simultaneously with steps (a) and (b), spraying a powdery material from a plurality of nozzles extending from a second manifold through the hood behind the first manifold and located behind the rotation axis to effectuate uniform mixing of the binder material with the tilled, prewetted base material and to prevent spreading of dust including the binder material outside of the shroud.

* * * * *